US011484923B2

(12) United States Patent
Castellani

(10) Patent No.: US 11,484,923 B2
(45) Date of Patent: Nov. 1, 2022

(54) PLANT FOR THE PRODUCTION AND THE PACKAGING OF STEEL BARS OR RODS

(71) Applicant: SMS MEER S.P.A., Tarcento UD (IT)

(72) Inventor: Federico Castellani, Tarcento UD (IT)

(73) Assignee: SMS MEER S.P.A., Tarcento UD (IT)

( * ) Notice: Subject to any disclaimer, the term of this patent is extended or adjusted under 35 U.S.C. 154(b) by 271 days.

(21) Appl. No.: 16/422,570

(22) Filed: May 24, 2019

(65) Prior Publication Data

US 2019/0275574 A1 Sep. 12, 2019

Related U.S. Application Data

(63) Continuation of application No. 14/369,694, filed as application No. PCT/IT2013/000003 on Jan. 3, 2013, now abandoned.

(30) Foreign Application Priority Data

Jan. 3, 2012 (IT) ..... VI2012A000001

(51) Int. Cl.

| | |
|---|---|
| ***B21B 43/00*** | (2006.01) |
| ***B21B 1/16*** | (2006.01) |
| *B21B 43/02* | (2006.01) |
| *B21B 43/12* | (2006.01) |

(52) U.S. Cl.

CPC ..... *B21B 1/16* (2013.01); *B21B 43/003* (2013.01); *B21B 43/02* (2013.01); *B21B 43/12* (2013.01)

(58) Field of Classification Search

CPC ..... B21B 39/002; B21B 39/08; B21B 39/004; B21B 39/18; B21B 43/003; B21B 43/02; B21B 43/04

See application file for complete search history.

(56) References Cited

U.S. PATENT DOCUMENTS

| | | | | |
|---|---|---|---|---|
| 7,219,521 | B1 * | 5/2007 | Eldredge | B21B 43/003 198/450 |
| 2004/0108631 | A1 * | 6/2004 | Castellani | B21B 43/003 266/105 |
| 2008/0196236 | A1 * | 8/2008 | Giuseppe | B21B 1/08 29/527.6 |

FOREIGN PATENT DOCUMENTS

| | | | |
|---|---|---|---|
| WO | 2005123292 | A1 | 12/2005 |
| WO | 2007003331 | A1 | 1/2007 |

* cited by examiner

*Primary Examiner* — Debra M Sullivan

(74) *Attorney, Agent, or Firm* — Innovation Capital Law Group, LLP; Vic Lin

(57) ABSTRACT

A plant for the production and packaging of bars and steel profiles includes a rolling station of rods and profiles of indefinite length, a cooling station, a scrap separation station, a diverter device, cutting shears, intended to cut said bars and profiles in bar portions having a fixed length, and a speed changing device, able to move the bar portions at a speed rate such that they can be placed within respective grooves or housing provided on the outer surface of at least one cylinder or rotating drum. Each cylinder or rotating drum is associated with a speed changing device, so that the housing receives bar portions at different speeds, depending on the fact that the housing belong to one first or to at least second rotating cylinder, in order to avoid overlap of the bar portions when the same are discharged onto the cooling plate.

16 Claims, 3 Drawing Sheets

PLANT FOR THE PRODUCTION AND THE PACKAGING OF STEEL BARS OR RODS

CROSS-REFERENCE TO RELATED APPLICATIONS

This application is a continuation of U.S. patent application Ser. No. 14/369,694, filed Jun. 28, 2014, the contents of which are herein incorporated by reference.

BACKGROUND OF THE INVENTION

1. Field of the Invention

The present invention generally relates to a plant for the production and the packaging of steel rods and profiles.

More particularly, the invention relates to a system and to a method for the continuous production and packaging of bars and/or steel profiles from liquid metal, comprising a steel block, composed of a melting furnace for scrap and secondary metallurgy, a block casting, act in particular billets, a block of extraction, a rolling block and a finishing block for the packaging of the bars in bundles of weight default and ready for sale, in which the aforesaid blocks are all in line.

2. Description of Prior Art and Related Information

Production facilities of bars and/or steel profiles from liquid metal with machinery in line and/or break points of the production line are already known, according to which the bars, which may have different cross sections, are produced by lamination and then cut and packed.

An example of a plant for the production and the packaging of steel bars of the traditional type and realized by the same Applicant is shown in the block diagram of FIGS. 1 and 2 attached (FIG. 2 is a sectional view taken along the line II-II of FIG. 1), where 1 denotes a bar of indefinite length present at the beginning of the production line, number 2 indicates the rolling stage, with 3 is shown a cooling station, with 4 is shown a separation station of the scrap, with 5 is indicated with a diverter device, while with 6 is shown a cutting shear for cut the bar 1 to a fixed length Lh (equal to the maximum length commercial) or lengths equal to one or more multiples of this length Lh, and with 7 is indicated with a speed changing device (braking device), able to handle the bar portions 1*a*, 1*b* at a speed rate such that the bar portions 1*a*, 1*b* can be placed within respective grooves or housing 18 (of length L) provided on the outer surface, respectively, of each drum or rotating cylinder 8*a*, 8*b*.

Therefore, in detail, each bar 1 of indefinite length at the entrance of the line system is divided by the shear 6 in bars 1*a*, 1*b* of fixed length Lh or having a length equal to one or more multiples of the fixed length Lh, while 5 the diverter device directs the bars 1*a*, 1*b*, alternately and respectively, in the rotating cylinder 8*a* and 8*b* in the rotating cylinder and the speed changing device 7 enables to restrain the bars 1*a*, 1*b*, so that the same reach a speed able to allow them to be inserted (according to the direction of flow F) inside the respective housings 18, of fixed length L, on the lateral surface of each rotating cylinder 8*a*, 8*b*.

In particular, the fixed length L of each housing 18 of the rotating cylinders 8*a*, 8*b* is greater than or equal to the maximum commercial length or fixed length Lh of each bar 1*a*, 1*b*.

The positions of the bars 1*a*, 1*b* inside the housing 18 are the same, both for the rotating cylinder 8*a* and for the rotating cylinder 8*b*, and, therefore, in this way, the cylinder 8*a* download a first 1*a* bar of a first seat 19 of a cooling plate or bed 13, which has means for transporting the bars 1*a*, such as moving knives or blades.

Subsequently, the moving knives move the first bar of a next seat 20 of the cooling plate 13 and the rotating cylinder 8*b* download the bar 1*b* on the first seat 19 of the cooling plate 13 before that the moving knives further transfer the bar 1*b* on the next seat 20.

The process continues in this way until the bars 1*a*, 1*b* arrive on suitable alignment rollers 9, where they are kept in place in order to be downloaded into a conveyor 14, in such a way as to form a suitable layer 15 composed of a plurality of bars 1*a*, 1*b* of length Lh. At this point, the layer 15 is moved toward the cutting shear 16, which shall, if necessary, cut the bars 1*a*, 1*b* of fixed length Lh to a further fixed length.

Thus forming a layer of bars 17 of fixed length, which is moved into the wrapping stations 10, into the binding stations 11 and into the packaging stations 12. The equipment described, as well as the production facilities of a known type, which provide packaging plant of the bars placed downstream of the rolling train, have some drawbacks, including that of not allowing a high packaging speed of the bars, not dealing with different profiles and not being substantially compact, which also makes it expensive.

SUMMARY OF THE INVENTION

As part of the above requirements, therefore, object of the present invention is to avoid the mentioned technical drawbacks and, in particular, to provide a plant for the production and packaging of bars and steel profiles, which allows to obtain a production line compact, reliable, efficient and of length substantially reduced, compared with prior art.

Another object of the invention is to provide a plant for the production and packaging of bars and steel profiles, which, compared to the prior art, it would be extremely flexible, resulting in a reduction of time and costs for implementation, and avoids any overlap of the bars on the plate or cooling bed.

A further object of the present invention is to provide a plant for the production and packaging of bars and steel profiles, which reduce both the investment and plant management costs, thereby reducing production times and increasing the packaging speed of the bars and thus the productivity.

These and other objects are achieved by providing a plant for the production and packaging of bars and steel profiles.

Advantageously, the system object of the present invention is particularly compact and versatile, since it allows continuous production, treatment and packaging of bars and/or profiles of various lengths, always maintaining an efficient production speeds, without the need to provide long waiting times in storage warehouses.

In particular, a series of rotating cylinders have respective seats formed on the lateral surface of the cylinder, adapted to house bars and/or profiles of commercial length, one after the other and at different speeds, in such a way that the arrest of the above bars in a direction perpendicular to the direction of rotation of the cylinders takes place at different times in relation to the respective cylinder, without however causing any overlapping of the bars when they are discharged onto the cooling plate.

By way of example and without limitative or exhaustive purposes, the areas of use of the fixing system of the invention are described in greater detail below.

BRIEF DESCRIPTION OF THE DRAWINGS

The objects and advantages mentioned above, as well as others which will emerge hereinafter, become more evident from the following description, relating to preferred embodiments of the invention, given as an example and preferred, but not limitative, and the attached drawings, in which.

DETAILED DESCRIPTION OF THE INVENTION

Figure 1:
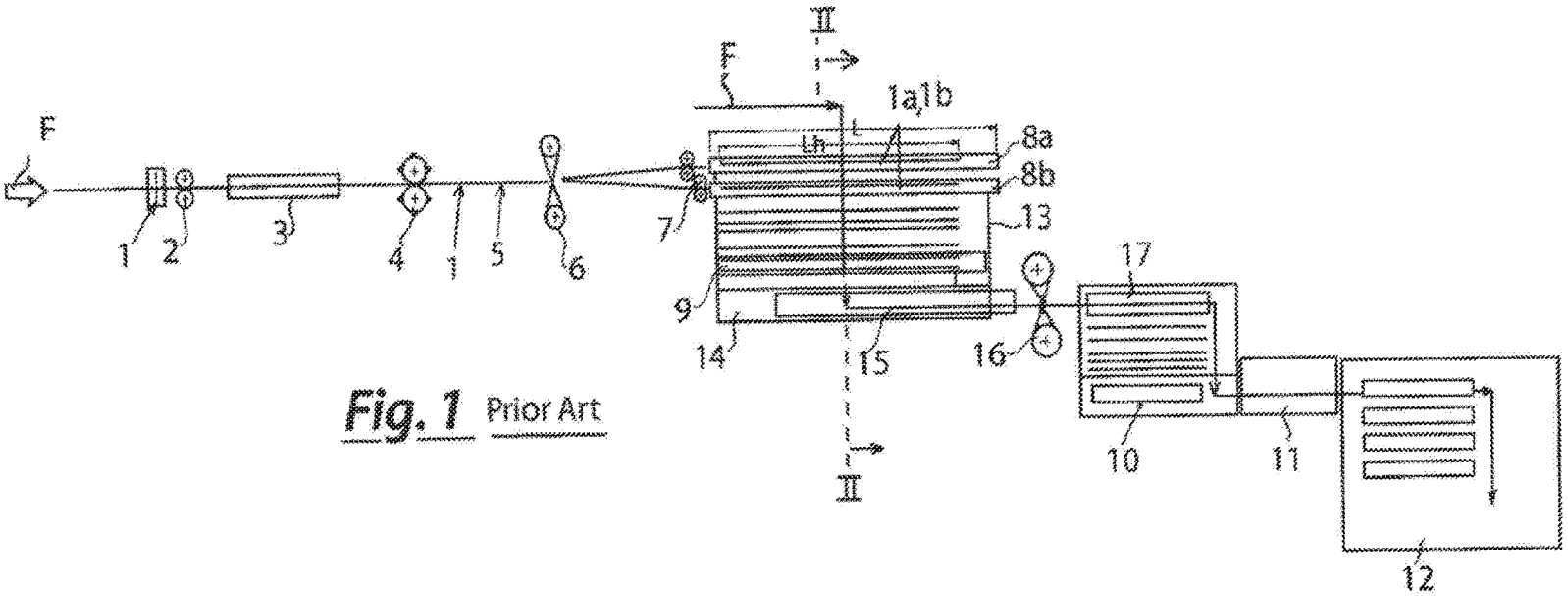
Fig. 1 Prior Art
FIG. 1 shows a block diagram of a plant for the production and packaging of bars and steel profiles, realized according to the prior art.
Figure 2:
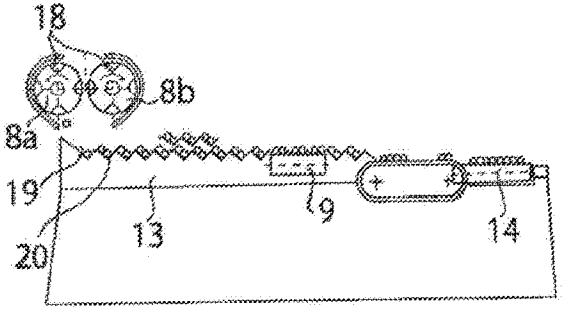
Fig. 2 Prior Art
FIG. 2 is a schematic sectional view taken along the line II-II of FIG. 1.
Figure 3:
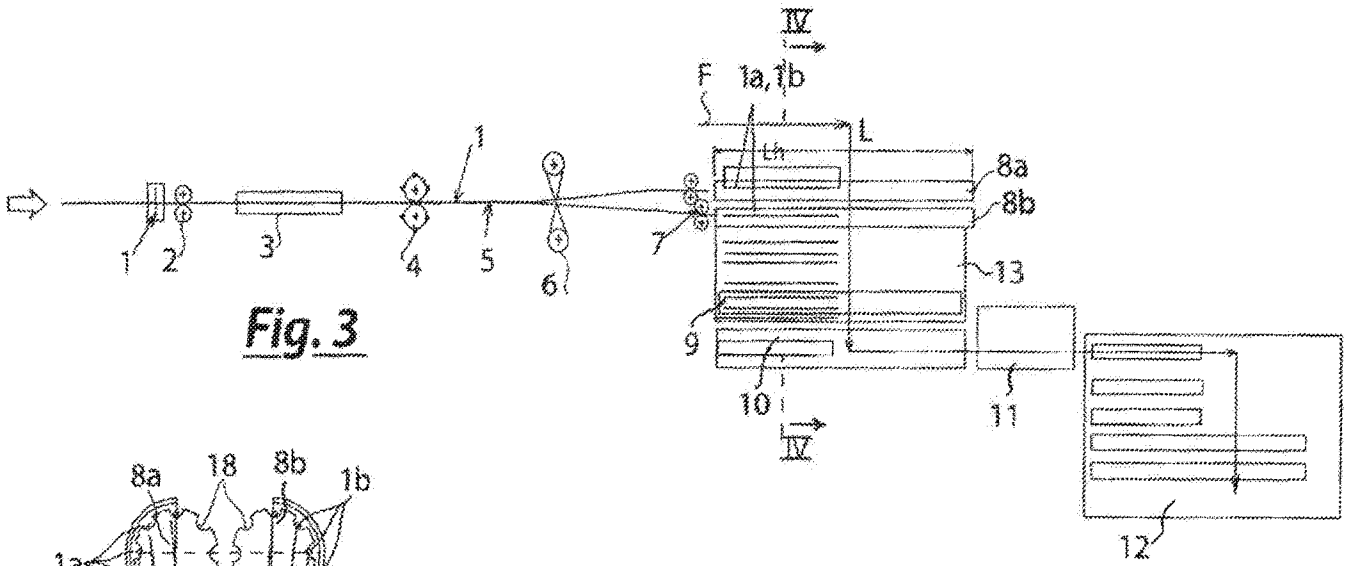
FIG. 3 shows a block diagram of a first embodiment of a plant for the production and packaging of bars and steel profiles according to the present invention.
Figure 4:
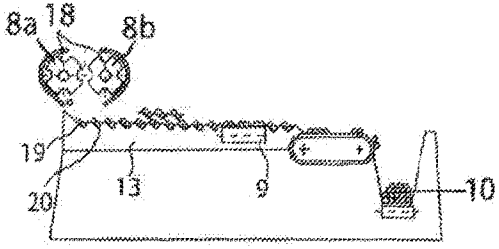
FIG. 4 is a schematic sectional view taken along the line IV-IV of FIG. 3.
Figure 5:
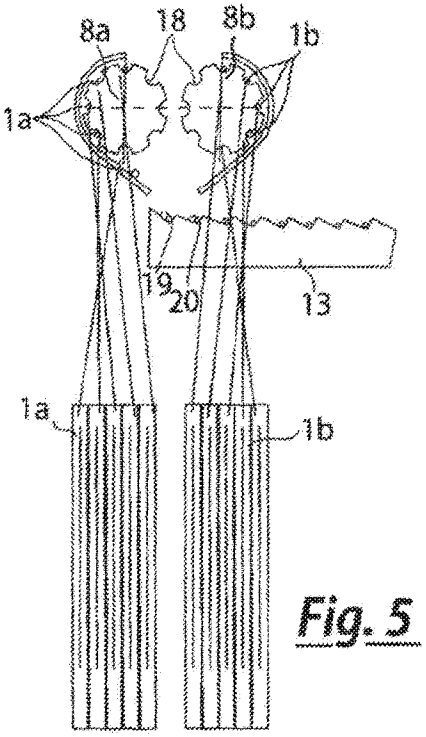
FIG. 5 is a schematic view of the deposition process of the bars on the plate or cooling bed implemented in the system of FIG. 3, according to the present invention.

With particular reference to FIGS. 3-5 mentioned, where the same elements of FIGS. 1 and 2 are indicated using the same reference numbers, with 1 is shown a bar or profile of indefinite length, which is placed at the beginning of the line, with 2 is indicated one rolling station, with 3 is shown a cooling station, with 4 is shown a scrap separation station, with 5 is indicated a diverter device, while with 6 is shown a cutting shear for cutting bars 1 to a fixed length Lh (equal to the maximum commercial length) or lengths equal to one or more multiples of the fixed length Lh, and with 7 is indicated a speed changing device (braking device), able to move the fixed length bar portions 1*a*, 1*b* at a speed rate able to brake and arrange the bars themselves 1*a*, 1*b* within each housing 18 (of length L, with L greater than the fixed length Lh), provided on the outer surface, respectively, of each rotating drum or cylinder 8*a*, 8*b*.

The housings 18 are constituted by as many grooves provided in the lateral surface of the rotating cylinders 8*a*, 8*b*, arranged horizontally and rotating about the axis of the cylinder.

The grooves of the rotating cylinders 8*a*, 8*b* placed higher receive the respective bar portions 1*a*, 1*b* from the rolling station 2, while the lower grooves unload the bar portions 1*a*, 1*b*, which had been previously received in the high position, on the cooling plate 13.

Furthermore, the speed changing device 7, installed in front of each rotating cylinder 8*a*, 8*b*, keeps the bar portions 1*a*, 1*b* at a suitable speed to stop and comfortably house said bar portions 1*a*, 1*b* into housings 18 of the rotating cylinders or drums 8*a*, 8*b*, while the diverter device 5 directs the bar portions 1*a*, 1*b* towards the grooves of the rotating cylinders 8*a*, 8*b*.

Then, each bar 1 of indefinite length at the entrance of the line system is divided, by the cutting shear 6, in bar portions 1*a*, 1*b* of fixed length Lh, which are housed inside the housings 18 of length L (with L>Lh and L greater than the length of the commercial bars), while the diverter device 5 directs the bars 1*a*, 1*b*, alternately and respectively, in the rotating cylinder 8*a* in the rotating cylinder and 8*b* and the speed changing device 7 enables to restrain the bars 1*a*, 1*b*, so that the same reach a speed able to allow them to be inserted (in the direction of flow F) inside the respective housings 18 on the lateral surface of each rotating cylinder 8*a*, 8*b*.

The positions of the bar portions 1*a*, 1*b* inside the seats 18 are the same, both for the rotating cylinder 8*a* that for the rotating cylinder 8*b*.

In particular, it is expected that the bars 1*a*, 1*b* are arranged in the housings 18 of each rolling cylinder, respectively, 8*a*, 8*b*, always in the same positions, in such a way that, during handling the discharge of said bars 1*a*, 1*b* on the plate or cooling bed 13, the same do not overlap each other.

In detail, both the cylinder 8*a* that the cylinder 8*b* downloading each a first bar portion 1*a*, 1*b* on a first receptacle 19 of the cooling plate 13, which has means for transporting the bar portions 1*a*, 1*b*, such as moving knives or blades.

Subsequently, the moving knives move the bar portions 1*a*, 1*b* of to a second seat 20 of the cooling plate 13 only after both the bars 1*a*, 1*b* are discharged from the respective cylinders 8*a*, 8*b*.

The process continues in this way until the bar portions 1*a*, 1*b* arrive on suitable alignment rollers 9, where they are kept in place in order to be downloaded into the wrapping station 10 and into a binding station 11 and into a packaging station 12.

Figure 6:
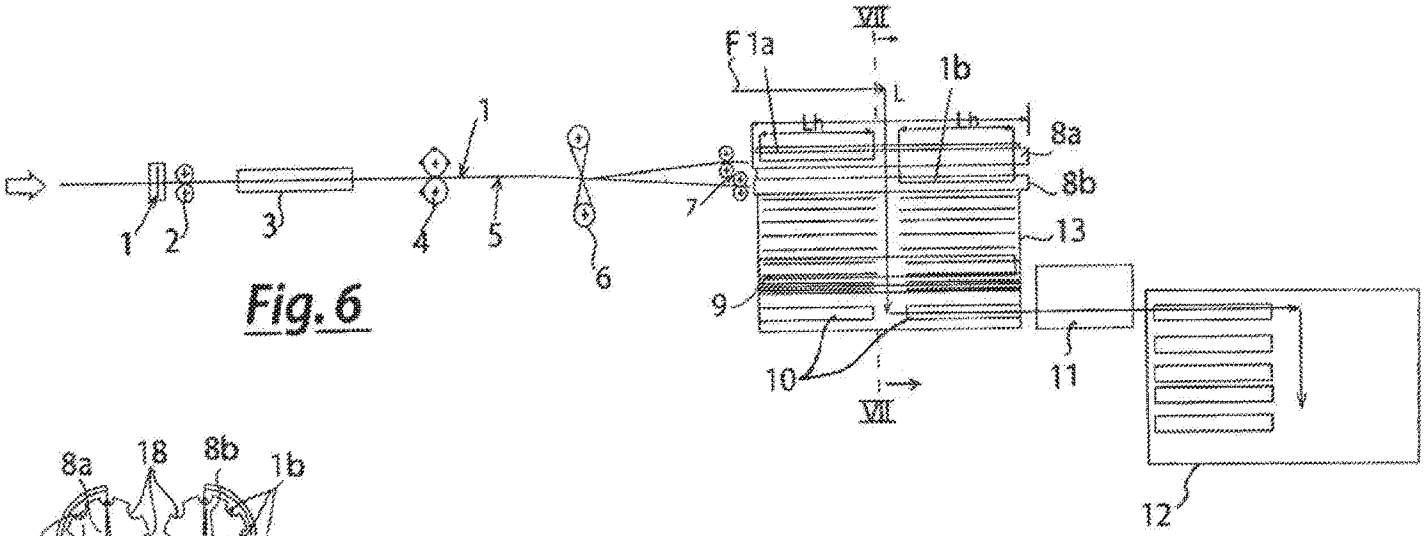
FIG. 6 shows a block diagram of a further embodiment of plant for the production and packaging of bars and steel profiles according to the present invention.
Figure 7:
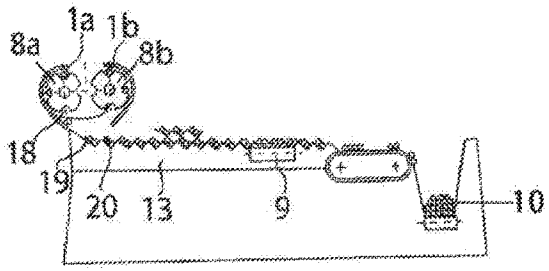
FIG. 7 is a schematic sectional view taken along the line VII-VII of FIG. 6.
Figure 8:
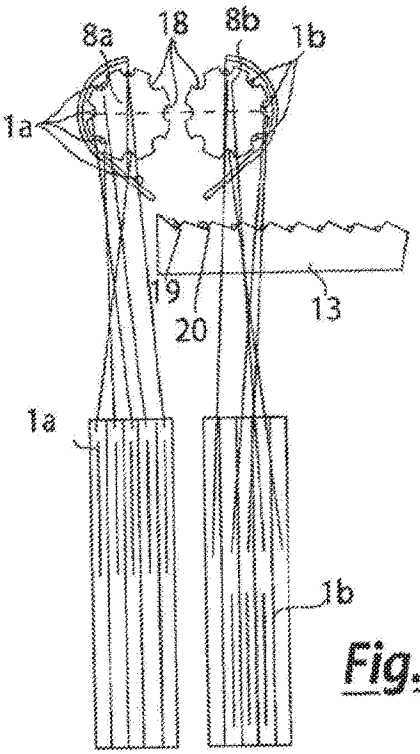
FIG. 8 is a schematic view of the deposition process of the bars on the plate or cooling bed implemented in the plant according to FIG. 6, according to the present invention.

In order to make better use of the capacity (limited) for housing the cooling plate 13, it is possible to use a system of production and packaging of bars and/or profiles such as that illustrated in the attached FIGS. 6-8, according to which the cutting shears 6 subdivide rods 1 of indefinite length in bar portions 1*a*, 1*b* of fixed length Lh (the length Lh is such that it is possible to accommodate 2 or more bar portions 1*a*, 1*b* within the length L, with L equal to the length of the housing 18 of each rotating cylinder 8*a*, 8*b*, and, in particular, Lh<½ L) and the diverter device 5 directs the bar portions 1*a*, 1*b*, alternately and respectively, towards the cylinder 8*a* and towards the cylinder 8*b*.

Furthermore, the speed changing device 7 installed in front of a relative rotating cylinder 8*a*, 8*b* maintains the respective bars first at a speed such that the above-mentioned first bars can be arranged in the housings 18 of the rotating cylinder 8*a*, while the speed changing device 7 installed in front of the rotating cylinder 8*b* maintains the respective bar portions 1*b* at a speed such that said bar portions 1*b* can be arranged in the housings 18 of the rotating cylinder 8*b* which are close to or close, but different, compared to the corresponding housings 18 of the rotating cylinder 8*a*, so as not to overlap the bar portions 1*a*, 1*b* onto the cooling plate 13.

Then, the positions of the bar portions 1*a*, 1*b* are always the same both inside the rotating cylinder 8*a* and inside the cylinder 8*b* (as shown in detail in the attached FIG. 8), and the rotating cylinders 8*a* and 8*b* download the bar portions 1*a*, 1*b* firstly on a first seat 19 of the cooling plate 13.

In particular, the positions of the bars 1*a*, 1*b* inside the respective cylinders 8*a*, 8*b* are such that, when said bars 1*a*, 1*b* are discharged onto the cooling plate 13, the same does not overlap each other and, specifically, it is expected that the first bars are always placed in a housing 18 of the rotating cylinders 8*a*, 8*b*, in successive positions, one row to another and not interfering with each other within said housing 18 (as shown in detail in the attached FIG. 8).

In this way, it is loaded, cyclically and alternately, firstly the entire housing 18 of a first rotating cylinder 8*a* and secondly another housing 18 of a second rotating cylinder 8*b*.

At this point and, therefore, only after that both the bar portions 1*a*, coming from the rotating cylinder 8*a*, and the bar portions 1*b*, coming from the rotating cylinder 8*b*, are placed in the seat 19 of the cooling plate 13, the moving blades of the cooling plate 13 to ensure transfer the bar portions 1*a*, 1*b* inside the seat 20, next and adjacent to the seat 19, of the cooling plate 13.

When the bar portions 1*a*, 1*b* arrive on alignment rollers 9, the same are kept in place in order to allow packaging and, in particular, the bars are first positioned on the inlet of the alignment rollers 9, while the bar portions 1*b* are placed at the output side of the alignment rollers 9.

In the wrapping station 10, placed in front of the binding stations 11 and packaging station 12, two bundles of bars are simultaneously formed.

From the above description, the technical characteristics of the plant for the production and packaging of bars and steel profiles, object of the present invention, are clear, as well as the advantages are also clear.

It's, finally, clear that different variations may be made to the plant in question, without departing from the principles of novelty inherent in the inventive idea according to the appended claims, just as it is clear that, in the practical embodiment of the invention, the materials, shapes and dimensions of the technical details may be any according to requirements and the same may be replaced with other elements that are technically equivalent.

What is claimed is:

1. A method for the production and packaging of steel bars, rods or profiles, comprising:

rolling bars, rods or profiles of indefinite length;

separating scrap from the bars, rods or profiles;

diverting the bars, rods or profiles into at least a first flow path and a second flow path;

cutting the bars, rods or profiles of the at least first and second flow paths into respective at least first and second portions having at least a first fixed length;

transporting the at least first and second portions of bars, rods or profiles at varying speeds along each of the respective at least first and second flow paths, the varying speeds adjusted with at least a first and a second speed changing device;

receiving, at an upper position, the at least first and second portions within grooves or housings on an outer surface of at least two rotating cylinders, wherein the grooves or housings have a second fixed length greater than the first fixed length and greater that a commercial length of the bars, rods or profiles, and a single one of the at least two cylinders is associated with a respective one of the at least first and second flow paths;

rotating the at least two cylinders to pass the at least first and second portions from the upper position to a lower position;

offloading the at least first and second portions from the grooves or housings onto a first seat of a cooling plate, wherein the first and second portions from one of the grooves or housings of both of the at least two cylinders are arranged end to end without overlap thereof in the first seat;

wherein the transporting the at least first and second portions further includes adjusting the variable speed of each of the first and second speed changing devices to handle the at least first and second portions at a respective set speed rate; and the receiving the at least first and second portions further includes positioning the first portion at a first axial position along the grooves or housings of a first cylinder of the at least two cylinders and positioning the second portion at a second axial position along the grooves or housings of a second cylinder of the at least two cylinders.

2. The method of claim 1, further comprising directing, respectively and alternately, the at least first and second portions into the first rotating cylinder and into the additional rotating cylinder.

3. The method of claim 1, further comprising transporting the at least first and second portions from the first seat to a second seat, adjacent the first seat, of the at least one cooling plate.

4. The method of claim 3, wherein the transporting step is performed only after the offload of at least one of the at least first and second portions from each of the first and additional rotating cylinders.

5. The method of claim 1, further comprising transporting the at least first and second portions from the at least one cooling plate, via alignment rollers, to a wrapping station and into a binding station and into a packaging station.

6. The method of claim 5, further comprising:

positioning at least the first portion of the at least first and second portions at a proximate side, relative to a feed direction thereof, of the alignment rollers;

positioning at least the second portion of the at least first and second portions at a distal side, relative to the feed direction thereof, of the alignment rollers; and simultaneously forming at least two bundles of bars in the wrapping station.

7. The method of claim 1, further comprising maintaining a speed of one of the at least first and second portions at a rate such that the one of the at least first and second portions are housed in the grooves or housings of the first rotating cylinder that is near or close to, but spaced from, the grooves or housings of at least one of the additional rotating cylinder, so that the at least first and second portions offloaded onto the cooling plate do not overlap.

8. The method of claim 1, further comprising loading the at least first and second portions, cyclically and alternately, a first groove or housing of the first rotating cylinder and, later, a second groove or housing of the additional rotating cylinder.

9. A method for the production and packaging of steel bars, rods or profiles, comprising:

feeding the bar, rod or profile of infinite length into a flow path of a line system;

separating scrap from the bars, rods or profiles;

diverting the flow path of bars, rods or profiles into at least a first flow path and a second flow path;

cutting the bars, rods or profiles of the at least first and second flow paths into respective at least first and second portions having at least a first fixed length;

adjusting a speed of the first and second flow paths of the respective at least first and second portions with respective at least first and second speed changing devices;

rotating at least two cylinders, a single one of the at least two cylinders for each respective one of the at least first and second flow paths, each of the cylinders having an outer surface with grooves or housings which, during the rotation, pass from an upper position to a lower position, wherein the grooves or housings have a second fixed length greater than the first fixed length;

adjusting the variable speed of each of the first and the second speed changing device to handle the at least first and second portions at a respective set speed rate;

receiving the at least first and second portions, moving at different speeds, within respective upper portions of the grooves or housings of the at least two cylinders; and offloading the at least first and second portions on a first seat of at least one cooling plate without overlap of the at least first and second portions.

10. The method of claim 9, further comprising directing, respectively and alternately, the at least first and second portions, along the respective first flow path and second flow path, into the first rotating cylinder and into the second rotating cylinder.

11. The method of claim 9, further comprising transporting the at least first and second portions from the first seat to a second seat, adjacent the first seat, of the at least one cooling plate.

12. The method of claim 11, wherein the transporting step is performed only after the offload of at least one of the at least first and second portions from each of the first and second rotating cylinders.

13. The method of claim 9, further comprising transporting the at least first and second portions from the at least one cooling plate, via alignment rollers, to a wrapping station and into a binding station and into a packaging station.

14. The method of claim 13, further comprising:

positioning at least the first portion of the at least first and second portions at a proximate side, relative to a feed direction thereof, of the alignment rollers;

positioning at least the second portion of the at least first and second portions at a distal side of the alignment rollers; and simultaneously forming at least two bundles of bars in the wrapping station.

15. The method of claim 9, further comprising positioning the first portion at a first axial position along the grooves or housings of a first cylinder of the at least two cylinders and positioning the second portion at a second axial position along the grooves or housings of a second cylinder of the at least two cylinders; and receiving both the at least first and second portions, as they are offloaded from one of the grooves or housings of both of the at least two cylinders, on a first seat cooling plate, wherein the first and second portions from one of the grooves of housings of both of the at least two cylinders are arranged end to end without overlap thereof in the first seat.

16. The method of claim 9, further comprising loading the at least first and second portions, cyclically and alternately, a first groove or housing of the first rotating cylinder and, later, a second groove or housing of the second rotating cylinder.

* * * * *